US006152582A

United States Patent [19]

Klaus

[11] Patent Number: 6,152,582

[45] Date of Patent: Nov. 28, 2000

[54] SPHERICAL-FORM TWIST-LOCK GLOBE HOLDER FOR A POST LAMP

[75] Inventor: Dale A. Klaus, St. Albans, Mo.

[73] Assignee: DAL Partnership, St. Louis, Mo.

[21] Appl. No.: 09/252,554

[22] Filed: Feb. 19, 1999

[51] Int. Cl.[7] ..... F21V 3/02

[52] U.S. Cl. ..... 362/363; 362/806; 362/431

[58] Field of Search ..... 362/363, 431, 362/806, 311

[56] References Cited

U.S. PATENT DOCUMENTS

| | | | |
|---|---|---|---|
| D. 376,666 | 12/1996 | Shalvi . | |
| 4,547,839 | 10/1985 | Ripley et al. . | |
| 4,549,252 | 10/1985 | Ripley et al. . | |
| 4,969,074 | 11/1990 | Davis et al. | 362/363 |
| 5,091,836 | 2/1992 | Neustadt . | |
| 5,161,881 | 11/1992 | Myson . | |
| 5,331,527 | 7/1994 | Stokes | 362/431 |
| 5,483,432 | 1/1996 | Wang | 362/431 |
| 5,526,243 | 6/1996 | Masters | 362/431 |
| 5,562,481 | 10/1996 | Myson . | |
| 5,666,021 | 9/1997 | Myson . | |

*Primary Examiner*—Thomas M. Sember
*Attorney, Agent, or Firm*—Polster, Lieder, Woodruff & Lucchesi

[57] ABSTRACT

A spherical form twist lock globe holder which is mountable to a lamp post and necked globe which is mountable to the globe holder are provided. The globe holder and globe are twist locked together. When the globe is mounted to the globe holder, the globe and globe holder define a substantially complete sphere. The globe is generally in the shape of a truncated sphere and has a generally flat bottom surface. A neck extends from the bottom surface, and a flange with gaps extends radially from the end of the neck. The globe has a center, a globe radius, and a distance from the globe center to a bottom of the globe neck. The distance from the globe center to the bottom of the neck is smaller than the radius of the globe. The globe holder has an arcuate base, preferably defining a segment of a sphere. A collar extends upwardly from the globe holder base and receives the globe neck. At least one arm extends up from the globe holder base and a finger extends from the arm. The globe holder finger engages the globe neck flange to twist lock the globe to the globe holder.

25 Claims, 5 Drawing Sheets

SPHERICAL-FORM TWIST-LOCK GLOBE HOLDER FOR A POST LAMP

BACKGROUND OF THE INVENTION

This invention relates to globe holders for use with outdoor post lamps, and in particular, to a twist locked spherical-form globe holder.

Globes are often used in association with outdoor lamps to encase the light bulb of the outdoor lamp. Such lamps may be mounted to a wall or a post. Alternately, the globe may be mounted to an arm extending from a wall or suspended from a ceiling, for example. Typically, the globes used with post-mounted outdoor lamps are formed generally as a sphere with a downwardly extending neck. The neck typically includes a flange which extends part way around the circumference of the neck.

To mount the globe on a post, a globe holder is typically used. The globe holders generally are formed from two types. The first is a simple ring holder which mates with the neck of the globe and twist locks on to the globe. One such a globe holder is sold by InterGlobal, Inc. as part number IG S048. Another ring holder is also shown, for example, in U.S. Pat. No. 376,666 to Shalvi. Such ring globe holders are generally cylindrical in shape and have an outer diameter that is greater than the outer diameter of the post to which the ring is mounted. Because the ring is visible between the globe and the post, it gives the outdoor lamp a "collar" look. That is, there is a visible step between the post and the globe. Many find this "collar" look undesirable.

Neckless globe holders have been provided to give the post and fixture cleaner lines. The use of a neckless globe holder gives the appearance of a sphere mounted directly to the post, without any intervening parts. An example of such a globe holder is sold by InterGlobal as part number IG S041. This globe holder includes a base in the shape of a spherical sector having a radius generally equal to the radius of the globe. The base is configured to mount on the top of the post. A pair of opposed clamps is formed in the inner surface of the holder base. To enable this holder to be used with the conventionally available necked globe, the neck of the globe must be cut off, and a larger opening must be formed in the globe at the base of the globe. The clamps interact with the edge of the opening of the globe to hold the globe to the globe holder. This globe holder gives the overall lamp a "lollipop" type look; i.e., a ball or sphere mounted directly on the post. Although this look is preferred to the "collar" look provided by the ring globe holder, the neckless globe holder is more expensive to make than the ring globe holder. The use of the neckless globe holder is made even more expensive by the need to modify the conventionally available necked globe so that the necked globe may be used with the clamp-style neckless globe holder. It would be desirable to provide a globe and neckless globe holder, which do not involve the expense of the clamp-style neckless globe holder or the processing required to enable a globe to be used with a neckless globe holder.

BRIEF SUMMARY OF THE INVENTION

A neckless globe holder and globe are provided which overcome the problems with the prior neckless globe holders. When the globe is mounted to the globe holder, the globe and globe holder define a substantially complete sphere. The globe and globe holder are constructed to be twist locked together. Thus, there is no clamp assembly on the globe holder which will increase the cost of the globe holder. Nor does the globe have to be modified to be used with the globe holder.

The globe is a necked globe. It is generally in the shape of a truncated sphere and has a generally flat bottom surface. A neck extends from the bottom surface, and a flange with gaps extends radially from the bottom of the neck to define flange sections. The flange sections are sloped or ramped. Each section thus has a narrower end and a thicker end. The globe has a center, a globe radius, and a distance from the globe center to a bottom of the globe neck. The distance from the globe center to the bottom of the neck is smaller than the radius of the globe.

The spherical form globe holder has an arcuate base, preferably defining a segment of a sphere. A collar extends upwardly from the base. The globe holder collar is hollow and opened at its bottom so that it can be placed over a lamp post, such as a post for an outdoor lamp. The globe neck is sized to fit over the globe holder collar.

At least one arm extending up from the globe holder base and a finger extends inwardly from the arm toward the collar. The distance between the finger and the base of the globe holder is approximately equal to the width of the thicker end of the globe flange sections. The gap in the globe flange is at least as wide as the globe holder base finger, and preferably wider. Thus, when the globe is mounted to the globe holder, the globe is twisted so that the globe flange is under the globe holder finger. The globe flange and globe holder finger form a friction fit to hold the globe to the globe holder. A screw hole is formed in the globe holder base to receive a screw. The screw hole is positioned so that when the globe is twisted onto the globe holder, the screw hole will align with one of the gaps in the globe flange. The screw extends through the base and into the globe flange gap. Thus, the screw will prevent the globe from being twisted to a position in which it could be removed from the globe holder.

To mount the globe holder to the lamp post, the globe holder collar is simply slid over the lamp post. A screw hole is formed in a radially outer wall of the collar, and a screw is passed through the screw hole into a hole in the collar to secure the globe holder to the collar.

The globe holder also includes a circumferential rib spaced from the globe holder collar and a drain hole in the base. The drain hole is formed on radially outer side of the rib, such that the drain hole will not be positioned between the rib and the base collar.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes what I presently believe is the best mode of carrying out the invention.

Figure 1:
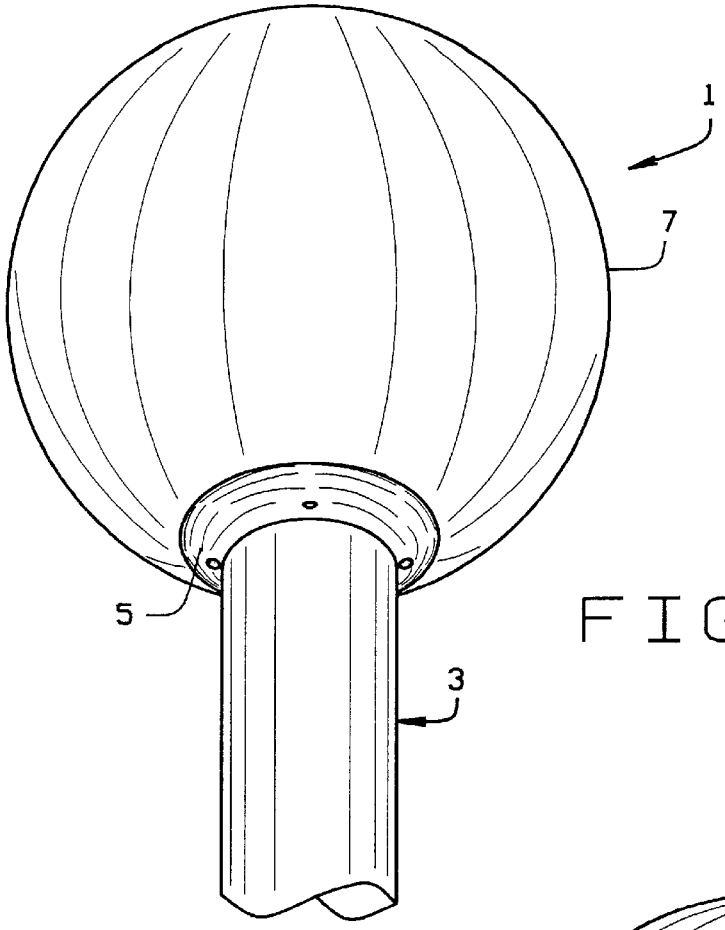
FIG. 1 is a perspective view of a lamp on a post including a necked twist lock globe and spherical-form twist lock globe holder of the present invention.
Figure 3:
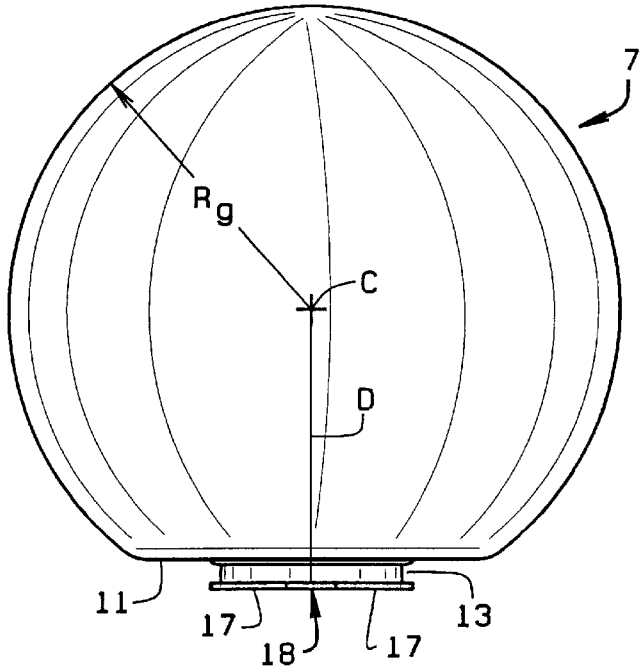
FIG. 3 is a side elevational view of the globe of the present invention.

An outdoor lamp 1 is shown generally in FIG. 1. The lamp 1 includes a post 3, a globe holder 5 mounted to the top of the post 3, and a globe 7 removably mounted to the globe holder 5. As is known, a bulb, such as an incandescent or fluorescent bulb, is housed in the globe 7. A socket (not shown) for the bulb is typically incorporated in, or mounted in, the globe holder 5. Electrical wires (not shown) extend through the post to connect the socket, and hence the bulb, to a source of electricity. The post can be a tall post for use with a driveway light, for example. Alternately, it can be a pier post or a post adapted to mount the lamp to a wall or suspend the lamp from a ceiling.

Figure 5:
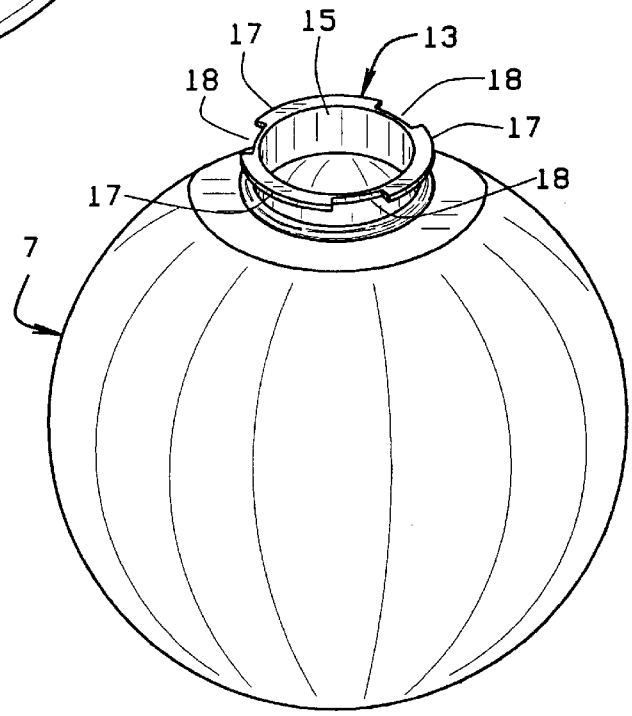
FIG. 5 is a bottom perspective view of the globe.
Figure 5A:
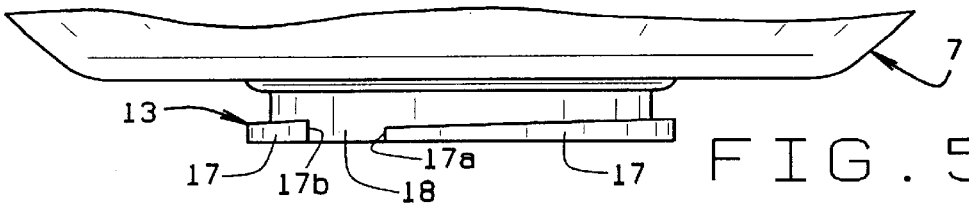
FIG. 5A is an enlarged fragmentary side elevational view of the globe, showing the ramped flange of the globe.
Figure 6:
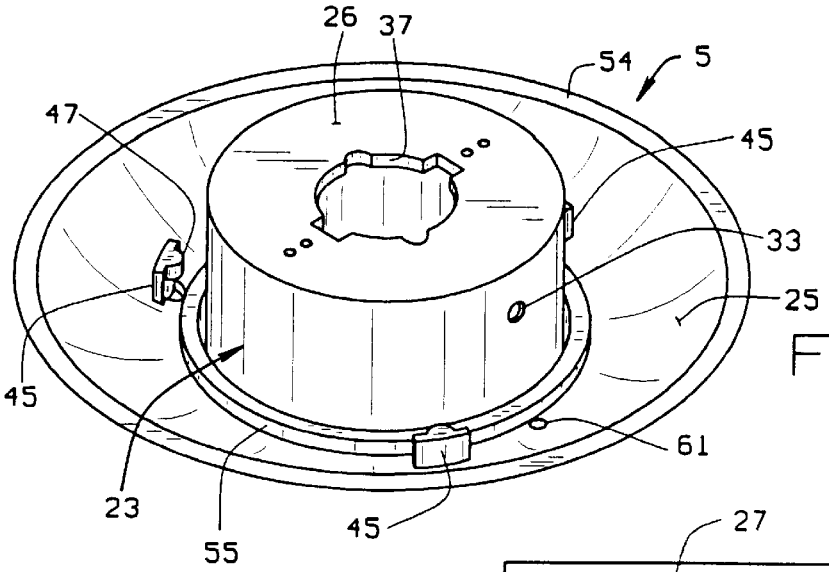
FIG. 6 is a perspective view of the spherical form twist lock globe holder of the present invention.
Figure 7:
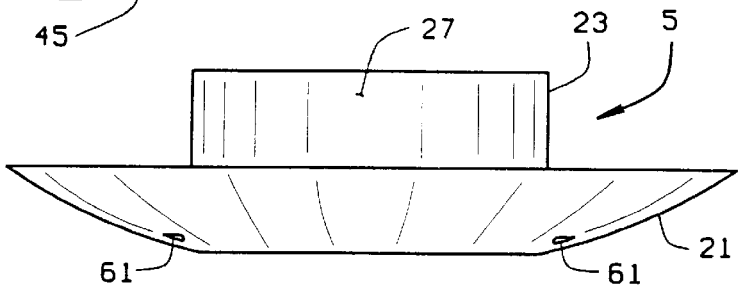
FIG. 7 is a side elevational view of the globe holder.
Figure 8:
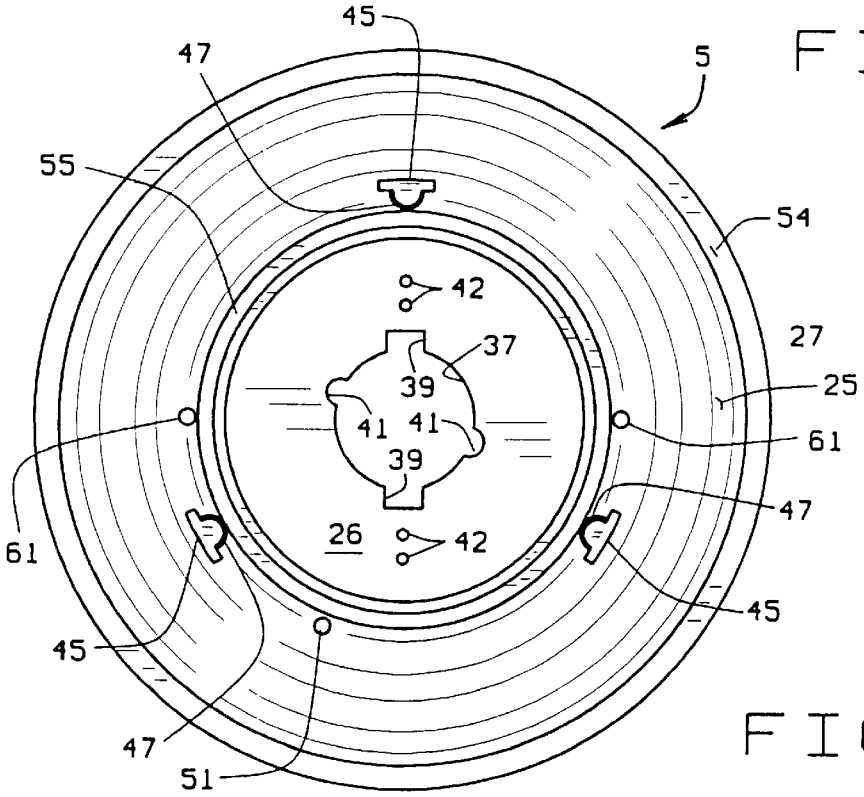
FIG. 8 is a top plan view of the globe holder.
Figure 9:
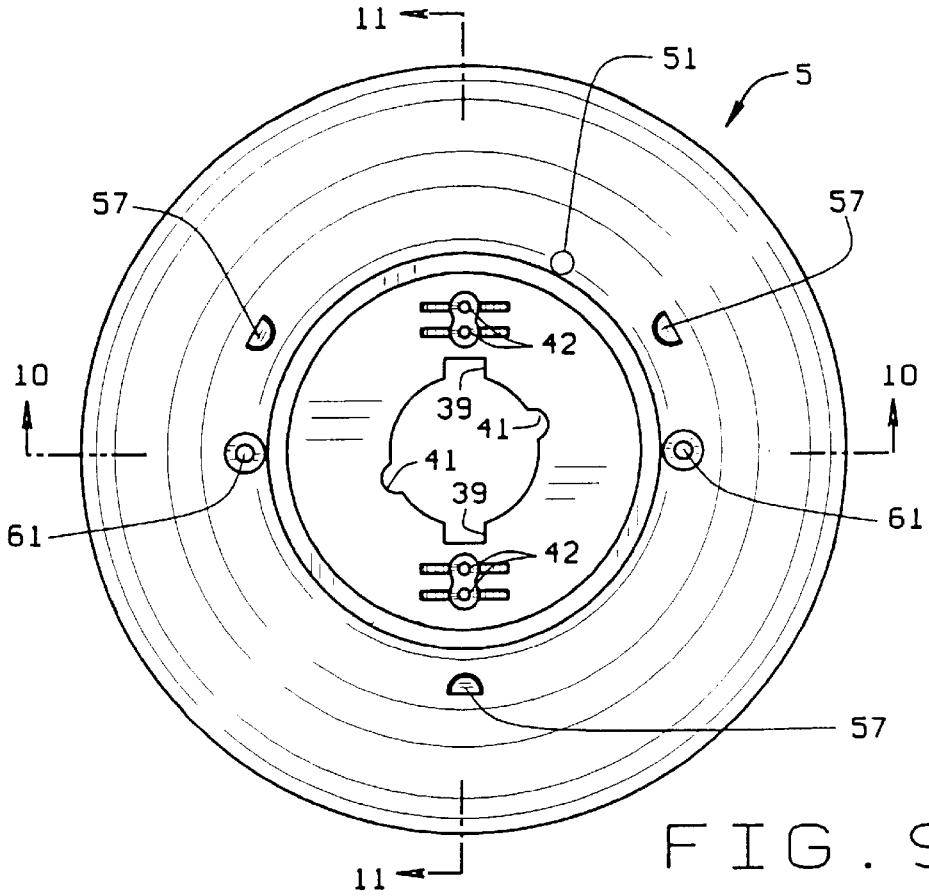
FIG. 9 is a bottom plan view of the globe holder.

The necked twist lock globe 7 is shown in detail in FIGS. 2–5. The globe is hollow and generally spherical. However, it is truncated such that the globe 7 has a flat bottom surface 11. A hollow neck 13 extends down from the bottom surface 11 generally in the center of the surface 11. The neck 13 is preferably generally circular in plan. The neck 13 is opened at its bottom 15 and communicates with the interior of the globe 7. The neck 13 includes a flange 17 extending around the circumference of the neck near the bottom of the neck. Gaps 18 are formed in the flange 17 to define flange sections. Three gaps 18 are shown. More or fewer gaps could be included if desired. The gaps are preferably fairly wide, having a length approximately one-half the length of the flange sections. Each flange section is sloped, as seen in FIG. 5A, and includes a narrower first end 17*a* and a wider trailing end 17*b*.

The globe 7 has a center C and a radius $R_g$. Importantly, the distance D from the globe center C to the bottom of the neck 13 is less than the radius $R_g$ of the globe 7. Thus, if the globe 7 were a complete sphere, the neck 13 would be encompassed by the globe 7.

Figure 2:
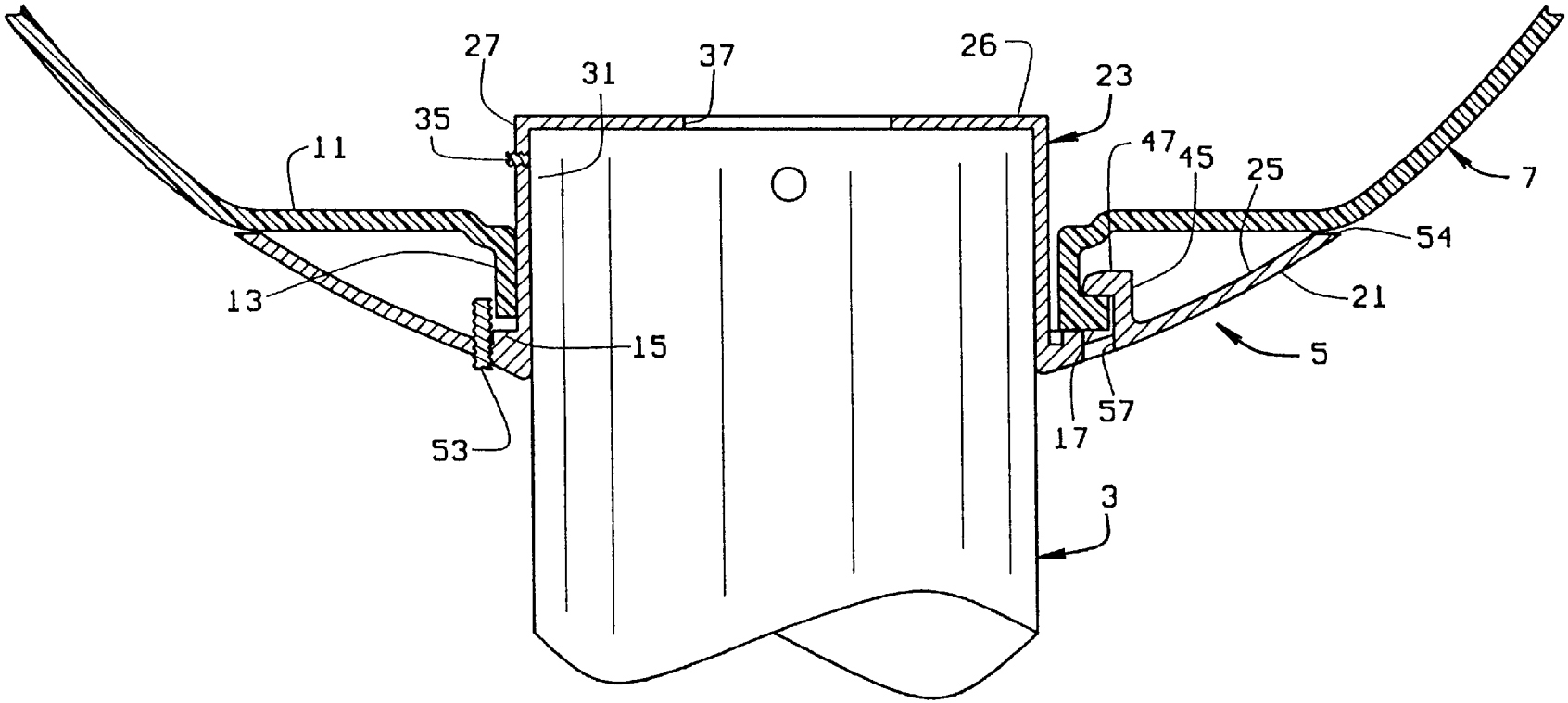
FIG. 2 is an enlarged, fragmentary cross-sectional view of the twist lock globe mounted on the globe holder.
Figure 4:
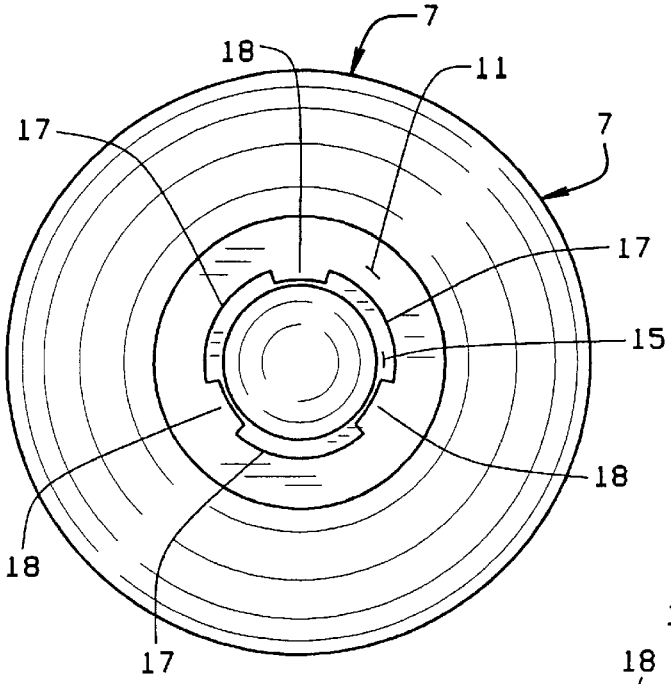
FIG. 4 is a bottom plan view of the globe.

The spherical-form twist lock globe holder 5 is shown in more detail in FIGS. 2 and 6–11. The globe holder 5 has a base 21 that defines a segment of a sphere. The base 21 is curved and has a radius $R_b$ that is substantially equal to the globe radius $R_g$. When the globe 7 is mounted to the holder 5, the holder 5 and globe 7 will, in combination, form a substantially complete sphere as seen in FIGS. 1 and 2.

Figure 10:
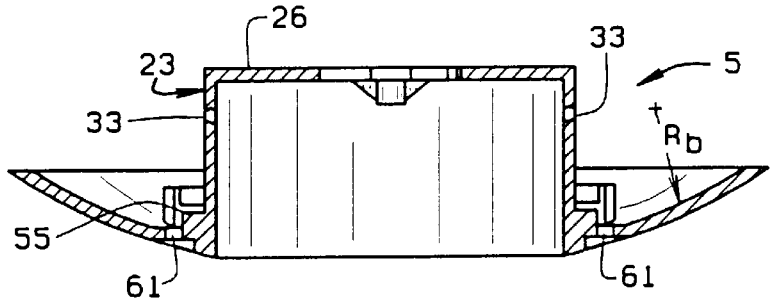
FIG. 10 is a cross-sectional view of the globe holder taken along line 10—10 of FIG. 9.

A collar 23 extends upwardly from the inner surface 25 of the globe holder base 21. The collar 23 is generally in the center of the base 21. As best seen in FIGS. 2 and 10, the collar 23 is opened at its bottom and extends above the top edge of the base 21. The collar 23 has a. top surface 26 and a side wall 27. The globe holder collar 23 is sized to fit over the lamp post 3. Preferably, the globe holder collar 23 is only slightly larger than the lamp post 3 so that the globe holder collar 23 will fit snugly on the lamp post 3. Preferably, the lamp post 3 and the globe holder collar 23 are both circular in plan. However, they could be formed in other shapes, if desired. The globe neck 13, in turn, is sized to fit over the base collar 23.

A screw hole 33 extends through the side wall 27 of the globe holder collar 23. When the globe holder 5 is mounted to the post 3, the installer drills holes in the post 3 which will align with the screw hole 33 in the globe holder collar 23. A self-tapping screw is screwed through the hole 33 and into the hole in the post. This secures the globe holder 5 to the post 3 to prevent accidental removal of the globe holder (and hence the light fixture) from the post 3.

A socket opening 37 is formed in the collar top surface 26 to receive a bulb socket. The socket is preferably for an incandescent or fluorescent bulb. Preferably, the socket accepts a compact fluorescent lamp, such as the socket shown in co-pending application Ser. No. 148,082, filed Sep. 4, 1998, which is incorporated herein by reference. Other types of bulb sockets, for example for a halogen bulb or other type of bulb, can also be used.

The socket opening 37 is preferably generally circular with a pair of oppositely disposed rectangular cutouts 39 and a pair of oppositely disposed arcuate cutouts 41. The rectangular cutouts 39 allow for the mounting of a snap-lock type socket to be mounted in the globe holder. The arcuate cutouts 41, in combination with the rectangular cutouts 39, enable a conventional square-shaped PL socket to be mounted in the globe holder. Additionally, holes 42 are provided on the collar top surface 25 to mount a ballast beneath the collar top surface 26. The holes 41 are shown to be on the same diameter line as the rectangular cutouts 39. However, they could be positioned elsewhere.

Three panels or arms 45 extend upwardly from the globe holder base inner surface 25. The panels 45 are spaced equally about the collar 23 and are spaced equally from the collar 23. Thus, if a line were drawn through the panels 45, they would define a circle concentric about the collar 23. A finger 47 extends from the top of each panel or arm 45 toward the collar 23. The fingers 23 are shown to be semi-circular in shape, but could be quadrilateral, triangular, or any other desired shape. The panels/arms 45 with their associated fingers 47 cooperate with the flange 17 of the globe neck 13 to mount the globe 7 to the globe holder 5 as seen in FIG. 2. The distance from the bottom of the fingers 47 to the holder base 21 is approximately equal to the height of the trailing end 17*b* of the globe flange sections. The side-to-side width of the arms 45 is less than the width of the gaps 18 in the flange 17

To mount the globe 7 to the globe holder 5, the globe neck 13 is slipped over the globe holder collar 23 and rotated until the gaps 18 in the flange 17 are aligned with the panel/arms 45. When the globe and globe holder are so arranged, the globe will drop into place on the globe holder. The globe 7 is then simply rotated relative to the globe holder 5 until the thicker end 17*b* of the flange sections engage the bottom surface of the globe holder fingers 47. At this point, the globe cannot be rotated any further, and the neck flange 17 and the globe holder fingers 47 create a friction fit with each other which will prevent the globe from being lifted off the globe holder.

To prevent the globe 7 from being easily removed from the globe holder 5, the globe holder includes at least one screw hole 51 that extends upwardly through the holder base 21. The screw hole is positioned on the globe holder base 21 such that when the globe 7 is twist locked onto the globe holder 5, the screw hole 51 will be aligned with one of the gaps 18 in the globe flange 17. A screw 53 is threaded through the screw hole 51 and extends into the gap 18. Although the screw 53 will not prevent slight twisting of the globe 7 relative to the globe holder 5, it will prevent the globe 7 from being rotated relative to the globe holder 5 to a position in which the globe 7 can be removed from the globe holder 5.

Figure 11:
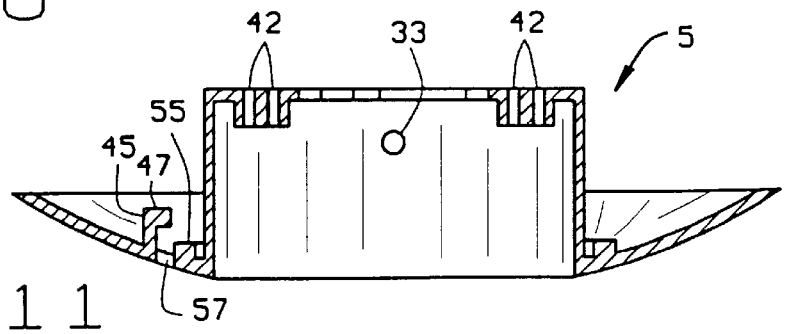
FIG. 11 is a cross-sectional view of the globe holder taken along line 11—11 of FIG. 9.

When the globe 7 is mounted on the globe holder 5, the top edge 54 of the globe holder base 21 is substantially adjacent the outer edge or perimeter of the globe bottom surface 11, as seen in FIG. 2, to create a spherical continuance or junction between the globe 7 and globe holder 5. As seen in FIG. 2, there can be a slight gap at the globe/globe holder junction through which water can enter and collect in the globe holder base 21. To substantially prevent the water from reaching the globe holder collar 23, a circumferential dam or rib 55 is positioned between the globe holder arms 45 and the globe holder collar 23. Drain holes 57 are provided radially outside of the dam 55 to allow whatever water enters the globe holder to exit the globe holder. The globe holder is preferably formed by injection molding. Thus, the drain holes 57 are preferably positioned beneath the globe holder fingers 47, as seen in FIG. 11.

As can be appreciated, the necked globe 7 and the globe holder 5, in combination, provide the appearance of a sphere mounted on a post to eliminate the "collar" look. The globe and globe holder are preferably made of plastic, for example by injection molding, and each is a single piece. Thus, the globe holder 7 can be inexpensively produced, relative to the cost of producing the prior clamp-style neckless globe holders. Additionally, the globe 7 is easily mounted to the globe holder without any need to modify either the globe holder 5 or the globe 7.

The globe holder 5 also includes a pair of oppositely positioned screw holes 61 which can be used to attach a clamp assembly (not shown) to the globe holder. This will allow the globe holder to be used with a neckless globe.

As various changes could be made in the above constructions without departing from the scope of the invention, it is intended that all matter contained in the above description or shown in the accompanying drawings shall be interpreted as illustrative and not in a limiting sense. For example, the globe neck 13 and the globe holder collar 23 can be threaded, so that the globe 7 can be screwed on to the globe holder 5. This would eliminate the need for the screw 53 and the set screw hole 51 in the base of the globe holder. Additionally, the globe holder collar 23 extends above the top edge 54 of the base 21. Thus, the rib 55 can be eliminated without worry about water reaching the level of the socket. The globe holder can be adapted so that the globe neck is received inside of the collar, rather than around the collar. These examples are merely illustrative.

What is claimed is:

1. A lamp assembly including a globe holder which is mountable to a post and a globe which is removably mountable to the globe holder;

the globe being generally in the shape of a truncated sphere having a generally flat bottom surface such that the globe defines a first segment of a sphere and a neck extending from the flat bottom surface, the neck having a wall spaced inwardly from a peripheral edge of said bottom surface; said first segment being less than 360°;

the globe holder having a base defining a second segment of a sphere and a collar extending upwardly from the base; the globe holder collar being sized to receive the globe neck;

the globe holder being adapted to engage the globe to mount the globe to the globe holder; the globe first spherical segment and the globe holder second spherical segment, in combination, defining a substantially complete sphere.

2. The lamp assembly of claim 1 wherein the globe has a center, a globe radius, and a distance from the globe center to a bottom of the globe neck; the distance from the globe center to the bottom of the neck being smaller than the radius of the globe.

3. The lamp assembly of claim 1 wherein the globe is twist locked onto the globe holder.

4. The lamp assembly of claim 3 wherein the globe includes a flange extending from the neck, the flange including at least one gap formed therein; the globe holder including at least one arm extending up from the globe holder base and a finger extending from the arm; the flange gap being at least as wide as the globe holder base finger; the globe flange and the globe holder finger forming a friction fit when the globe is mounted to the globe holder.

5. The lamp assembly of claim 4 wherein the flange is ramped and has a first end and a trailing end; the trailing end being thicker than the first end.

6. The lamp assembly of claim 1 wherein the base to which the globe holder is mounted is a post; the globe holder collar being hollow and having a shape corresponding to the shape of the post to be slideable over the post; the globe holder including a screw hole in a side of the globe holder collar which receives a screw, the screw being rotatable to engage the lamp post to secure the globe holder to the lamp post.

7. The lamp assembly of claim 1 wherein the globe holder includes a circumferential rib on an inner surface of the globe holder base, said rib being spaced from the globe holder collar.

8. The lamp assembly of claim 1 wherein the globe holder includes at least one drain hole in the globe holder base.

9. The lamp assembly of claim 1 wherein said globe and said globe holder base each define a radius, the radius of said globe holder base being substantially equal to the radius of said globe.

10. The lamp assembly of claim 1 wherein said globe holder collar has a diameter approximately equal to the post diameter; said post telescopically receiving said globe holder collar.

11. The lamp assembly of claim 1 wherein the globe holder has an outer surface defined by said globe holder base, said globe holder being arcuate in shape.

12. A lamp assembly including a globe holder which is mountable to a post and a globe which is removably mountable to the globe holder, said globe being twist locked onto the globe holder;

the globe being generally in the shape of a truncated sphere having a generally flat bottom surface, a neck extending from the bottom surface, and a flange extending from the neck, the flange including at least one gap formed therein;

the globe holder having an arcuate base, a collar extending upwardly from the base, at least one arm extending up from the globe holder base, and a finger extending from the arm; the globe holder collar being sized to receive the globe neck; the flange gap being at least as wide as the globe holder base finger; the globe flange and the globe holder finger forming a friction fit when the globe is mounted to the globe holder;

the globe holder including a screw hole in the globe holder base; the screw hole being positioned to be aligned with the flange gap when the globe is mounted to the globe holder; whereby, when a screw is threaded through the screw hole, the screw will extend into the gap to prevent the globe from being rotated relative to the globe holder to a position where the globe can be removed from the globe holder;

the globe holder being adapted to engage the globe to mount the globe to the globe holder; whereby, when the globe is mounted to the globe holder, the globe and globe holder define a substantially complete sphere.

13. In combination, a globe holder which is mountable to a lamp post and a necked globe which is removably mountable to the globe holder;

the globe being generally in the shape of a truncated sphere having a generally flat bottom surface such that the globe defines a first segment of a sphere and a neck extending from the bottom flat surface, the neck having a wall spaced inwardly from a peripheral edge of said bottom surface; said first segment being less than 360°;

the globe holder having a base defining a second segment of a sphere and a collar extending upwardly from the base; the globe holder collar being sized to receive the globe neck;

the globe holder being adapted to engage the globe to mount the globe to the globe holder; the globe first spherical segment and the globe holder second spherical segment, in combination, defining a substantially complete sphere.

14. The combination of claim 13 wherein the globe is twist locked onto the globe holder.

15. The lamp assembly of claim 14 wherein the globe includes a ramped flange extending from the neck, the flange including at least one gap formed therein; the flange having a first end and a second end thicker than the first end; the globe holder including at least one arm extending up from the globe holder base and a finger extending from the arm; the flange gap being at least as wide as the globe holder base finger; the globe flange and the globe holder finger forming a friction fit when the globe is mounted to the globe holder.

16. The combination of claim 13 wherein the globe holder includes a circumferential rib on an inner surface of the globe holder base, said rib being spaced from the globe holder column.

17. The combination of claim 13 wherein the globe holder includes at least one drain hole in the globe holder base.

18. The combination of claim 13 wherein the globe holder column has a top surface and an opening in the top surface; the opening being adapted to receive a socket for a bulb.

19. In combination, a globe holder which is mountable to a lamp post and a necked globe which is removably mountable to the globe holder; the globe being twist locked onto the globe holder;

the globe being generally in the shape of a truncated sphere having a generally flat bottom surface, a neck extending from the bottom surface, and a ramped flange extending from the neck, the flange including at least one gap formed therein; the flange having a first end and a second end thicker than the first end;

the globe holder having an arcuate base, a collar extending upwardly from the base, and at least one arm extending up from the globe holder base with a finger extending from the arm; the flange gap being at least as wide as the globe holder base finger; the globe flange and the globe holder finger forming a friction fit when the globe is mounted to the globe holder; the globe holder collar being sized to receive the globe neck;

the globe holder including a screw hole in the globe holder base; the screw hole being positioned to be aligned with a flange gap when the globe is mounted to the globe holder; whereby, when a screw is threaded through the screw hole, the screw will extend into the gap to prevent the globe from being rotated relative to the globe holder to a position where the globe can be removed from the globe holder;

the globe holder being adapted to engage the globe to mount the globe to the globe holder; whereby, when the globe is mounted to the globe holder, the globe and globe holder define a substantially complete sphere.

20. A spherical form twist lock globe holder for mounting a necked globe to a lamp post, the necked globe defining a radius; the globe holder comprising:

a base being generally in the shape of a segment of a sphere and defining a radius of the sphere, the base having an inner surface and an outer surface; and a collar extending up from the base inner surface, the collar being adapted to telescopically receive the globe neck to mount the globe to the globe holder, whereby when the globe is mounted to the globe holder, the globe and globe holder substantially define a sphere.

21. The globe holder of claim 20 including at least one drain hole in the base.

22. The globe holder of claim 21 including a dam on an inner surface of the base and extending around the collar and spaced from the collar; the at least one drain hole being positioned on an opposite side of the dam from the collar.

23. The globe holder of claim 20 wherein the globe holder twistingly receives the globe neck.

24. The globe holder of claim 23 including at least one arm extending upwardly from the base spaced from the base collar and a finger extending from the arm over the base.

25. The globe holder of claim 24 wherein the finger extends toward the base collar.

* * * * *